US006158529A

United States Patent [19]

Dorel

[11] Patent Number: 6,158,529

[45] Date of Patent: Dec. 12, 2000

[54] ROTARY STEERABLE WELL DRILLING SYSTEM UTILIZING SLIDING SLEEVE

[75] Inventor: Alain P. Dorel, Houston, Tex.

[73] Assignee: Schlumberger Technology Corporation, Sugar Land, Tex.

[21] Appl. No.: 09/210,520

[22] Filed: Dec. 11, 1998

[51] Int. Cl.[7] ..... E21B 7/04

[52] U.S. Cl. ..... 175/61

[58] Field of Search ..... 175/61, 62, 73, 175/76, 24

[56] References Cited

U.S. PATENT DOCUMENTS

| | | |
|---|---|---|
| Re. 33,751 | 11/1991 | Geczy et al. . |
| 2,319,236 | 5/1943 | Isaacks et al. . |
| 2,687,282 | 8/1954 | Sanders . |
| 2,694,549 | 11/1954 | James . |
| 2,876,992 | 3/1959 | Lindsay . |
| 3,068,946 | 12/1962 | Frisby et al. . |
| 3,098,534 | 7/1963 | Carr et al. . |
| 3,370,657 | 2/1968 | Antle . |
| 3,457,999 | 7/1969 | Massey . |
| 3,561,549 | 2/1971 | Garrison . |
| 3,575,247 | 4/1971 | Feenstra . |
| 3,637,032 | 1/1972 | Jeter . |
| 3,667,556 | 6/1972 | Henderson . |
| 3,743,034 | 7/1973 | Bradley . |
| 3,799,279 | 3/1974 | Farris . |
| 3,878,903 | 4/1975 | Cherrington . |
| 3,903,974 | 9/1975 | Cullen . |
| 4,040,494 | 8/1977 | Kellner . |

(List continued on next page.)

FOREIGN PATENT DOCUMENTS

| | | |
|---|---|---|
| 0 343 800 A2 | 11/1989 | European Pat. Off. . |
| 0 520 733 A1 | 12/1992 | European Pat. Off. . |
| 0 530 045 A1 | 3/1993 | European Pat. Off. . |
| 0 744 526 A1 | 11/1996 | European Pat. Off. . |
| 27 34 020 A1 | 2/1979 | Germany . |
| 2 172 324 | 7/1988 | United Kingdom . |
| 2 172 325 | 7/1988 | United Kingdom . |
| 2 177 738 | 8/1988 | United Kingdom . |
| 2 246 151 | 1/1992 | United Kingdom . |
| WO 96/31679 | 10/1996 | WIPO . |

OTHER PUBLICATIONS

Anadrill Schlumberger Brochure, Anadrill Tightens Directional Control with Downhole–Adjustable Stabilizers, no date.

(List continued on next page.)

*Primary Examiner*—Robert E. Pezzuto
*Assistant Examiner*—Kristine Markovich
*Attorney, Agent, or Firm*—Steven L. Christian; Wayne Kanak

[57] ABSTRACT

An actively controlled rotary steerable drilling system for directional drilling of wells, the system having a rotary drive component rotatable within a tubular sliding tool collar that incorporates elastic anti-rotation members to maintain a coupled relation with the borehole wall during drilling. An offsetting mandrel is supported within the tool collar by a knuckle joint for pivotal movement and for rotation relative to the tool collar and has a lower end extending from the tool collar and supporting a drill bit. To achieve controlled steering of the rotating drill bit, orientation of the tool collar is sensed and the offsetting mandrel is maintained geostationary and selectively axially inclined relative to the tool collar by orienting it about the knuckle joint. An alternator and a hydraulic pump, located within the tool collar, are driven by relative rotation of the rotary drive component with the tool collar to produce electric power and hydraulic pressure for the electronics package of the tool and for actuation of hydraulic system components. Hydraulic cylinder and piston assemblies, actuated by tool position signal responsive solenoid valves, control the angular position of the offsetting mandrel with respect to the tool collar. The hydraulic pistons are servo-controlled responsive to signal input from tool position sensing systems such as magnetometers and accelerometers which provide real-time position signals to the hydraulic control system.

26 Claims, 4 Drawing Sheets

U.S. PATENT DOCUMENTS

| | | |
|---|---|---|
| 4,040,495 | 8/1977 | Kellner et al. . |
| 4,076,084 | 2/1978 | Tighe . |
| 4,080,115 | 3/1978 | Sims et al. . |
| 4,184,553 | 1/1980 | Jones, Jr. et al. . |
| 4,185,704 | 1/1980 | Nixon, Jr. . |
| 4,211,292 | 7/1980 | Evans . |
| 4,220,213 | 9/1980 | Hamilton . |
| 4,291,773 | 9/1981 | Evans . |
| 4,305,474 | 12/1981 | Farris et al. . |
| 4,416,339 | 11/1983 | Baker et al. . |
| 4,428,441 | 1/1984 | Dellinger . |
| 4,449,595 | 5/1984 | Holbert . |
| 4,456,080 | 6/1984 | Holbert . |
| 4,461,359 | 7/1984 | Jones, Jr. et al. . |
| 4,465,147 | 8/1984 | Feenstra et al. . |
| 4,492,276 | 1/1985 | Kamp . |
| 4,523,652 | 6/1985 | Schuh . |
| 4,560,013 | 12/1985 | Beimgraben . |
| 4,635,736 | 1/1987 | Shirley . |
| 4,637,479 | 1/1987 | Leising . |
| 4,638,873 | 1/1987 | Welborn . |
| 4,662,458 | 5/1987 | Ho . |
| 4,667,751 | 5/1987 | Geczy et al. . |
| 4,697,651 | 10/1987 | Dellinger . |
| 4,699,224 | 10/1987 | Burton . |
| 4,714,118 | 12/1987 | Baker et al. . |
| 4,732,223 | 3/1988 | Schoeffler et al. . |
| 4,739,843 | 4/1988 | Burton . |
| 4,807,708 | 2/1989 | Forrest et al. . |
| 4,811,798 | 3/1989 | Falgout, Sr. et al. . |
| 4,821,815 | 4/1989 | Baker et al. . |
| 4,828,050 | 5/1989 | Hashimoto . |
| 4,836,301 | 6/1989 | Van Dongen et al. . |
| 4,848,490 | 7/1989 | Anderson . |
| 4,858,705 | 8/1989 | Thiery . |
| 4,867,255 | 9/1989 | Baker et al. . |
| 4,880,067 | 11/1989 | Jelsma . |
| 4,895,214 | 1/1990 | Schoeffler . |
| 4,901,804 | 2/1990 | Thometz et al. . |
| 4,938,298 | 7/1990 | Rehm . |
| 4,947,944 | 8/1990 | Coltman et al. . |
| 4,948,925 | 8/1990 | Winters et al. . |
| 4,951,760 | 8/1990 | Cendre et al. . |
| 4,995,465 | 2/1991 | Beck et al. . |
| 5,050,692 | 9/1991 | Beimgraben . |
| 5,052,501 | 10/1991 | Wenzel et al. . |
| 5,103,919 | 4/1992 | Warren et al. . |
| 5,113,953 | 5/1992 | Noble . |
| 5,117,927 | 6/1992 | Askew . |
| 5,131,479 | 7/1992 | Boulet et al. . |
| 5,139,094 | 8/1992 | Prevedel et al. . |
| 5,163,521 | 11/1992 | Pustanyk et al. . |
| 5,213,168 | 5/1993 | Warren et al. . |
| 5,220,963 | 6/1993 | Patton . |
| 5,265,682 | 11/1993 | Russell et al. . |
| 5,265,687 | 11/1993 | Gray . |
| 5,305,830 | 4/1994 | Wittrisch . |
| 5,305,838 | 4/1994 | Pauc . |
| 5,311,952 | 5/1994 | Eddison et al. . |
| 5,311,953 | 5/1994 | Walker . |
| 5,316,093 | 5/1994 | Morin et al. . |
| 5,325,714 | 7/1994 | Lende et al. . |
| 5,332,048 | 7/1994 | Underwood et al. . |
| 5,343,966 | 9/1994 | Wenzel et al. . |
| 5,375,098 | 12/1994 | Malone et al. . |
| 5,410,303 | 4/1995 | Comeau et al. . |
| 5,421,420 | 6/1995 | Malone et al. . |
| 5,467,834 | 11/1995 | Hughes et al. . |
| 5,484,029 | 1/1996 | Eddison . |
| 5,520,256 | 5/1996 | Eddison . |
| 5,529,133 | 6/1996 | Eddison . |
| 5,594,343 | 1/1997 | Clark et al. . |
| 5,602,541 | 2/1997 | Comeau et al. . |
| 5,617,926 | 4/1997 | Eddison et al. . |
| 5,738,178 | 4/1998 | Williams et al. . |

OTHER PUBLICATIONS

Baker Hughes Inteq. "Rotary Directional Drilling System Enhances Steering with Less Torque and Drag", *Harts Petroleum Engineer International*, Apr. 1997, P. 30.

Barr, J.D., et al., "Steerable Rotary Drilling With an Experimental System", SPE/IADC 29382, presented at the 1995 SPE/IADC Drilling Conference, Amsterdam, The Netherlands, Feb. 28–Mar. 2, 1995, 16 pages.

Bell, S., "Automated rotary steerable tool passes test", *World Oil*, Dec. 1996, p. 31.

Colebrook, , M.A. , et al., "Application of Steerable Rotary Drilling Technology to Drill Extended Reach Wells", IADC/SPE 39327, Presented at the 1998 IADC/SPE Drilling Conference, Dallas, Texas, Mar. 3–6, 1998, 11 pages.

Oppelt, J., et al., "Rotary Steerable Drilling System: Status of Development", *Current Issues in Drilling Technology*, GEOPEC, Aberdeen, UK, Sep. 18 and 19, 1996.

Rich, G., et al, "Rotary Closed Loop Drilling System Designed For The Next Millennium", *Hart's Petroleum Engineer International*, May 1997, pp. 47–53.

Warren, T.M., "Trends toward rotary steerable directional systems", *World Oil*, May 1997, pp. 43–47.

Search Report from European Patent Office, dated Mar. 31, 2000.

ROTARY STEERABLE WELL DRILLING SYSTEM UTILIZING SLIDING SLEEVE

BACKGROUND OF THE INVENTION

1. Field of the Invention

This invention relates generally to methods and apparatus for drilling wells, particularly wells for the production of petroleum products, and more specifically concerns an actively controlled rotary steerable drilling system that can be connected directly to a rotary drill string or can be connected in a rotary drill string in assembly with a mud motor and/or thruster and/or flexible sub to enable drilling of deviated wellbore sections and branch bores. This invention also concerns methods and apparatus enabling precision control of the direction of a wellbore being drilled. This invention also concerns an actively controlled rotary steerable drilling system incorporating a hydraulically energized bit shaft positioning mechanism for accomplishing automatic geostationary positioning of the axis of an offsetting mandrel and drill bit during rotation of the offsetting mandrel and drill bit by a rotary drill string, mud motor or both. This invention further concerns elongate elastic anti-rotation blades projecting radially from the sliding tool collar for maintaining anti-rotation of the drilling tool with the borehole wall.

2. Description of Related Art

An oil or gas well often has a subsurface section that is drilled directionally, i.e., inclined at an angle with respect to the vertical and with the inclination having a particular compass heading or azimuth. Although wells having deviated sections may be drilled at any desired location, such as for "horizontal" borehole orientation or deviated branch bores from a primary borehole, for example, a significant number of deviated wells are drilled in the marine environment. In such case a number of deviated wells are drilled from a single offshore production platform in a manner such that the bottoms of the boreholes are distributed over a large area of a producing horizon over which the platform is typically centrally located, and wellheads for each of the wells are located on the platform structure.

In circumstances where the well being drilled is of complex trajectory, the capability provided by the rotary steerable drilling system of this invention to steer the drill bit while the drill bit is being rotated by the collar of the tool enables drilling personnel to readily navigate the wellbore being drilled from one subsurface oil reservoir to another. The rotary steerable drilling tool of the present invention enables steering of the wellbore both from the standpoint of inclination and from the standpoint of azimuth so that two or more subsurface zones of interest can be controllably intersected by the wellbore being drilled.

A typical procedure for drilling a directional borehole is to remove the drill string and drill bit by which the initial, vertical section of the well was drilled using conventional rotary drilling techniques, and run in a mud motor having a bent housing at the lower end of the drill string which drives the bit in response to circulation of drilling fluid. The bent housing provides a bend angle such that the axis below the bend point, which corresponds to the rotation axis of the bit, has a "toolface" angle with respect to a reference, as viewed from above. The toolface angle, or simply "toolface", establishes the azimuth or compass heading at which the deviated borehole section will be drilled as the mud motor is operated. After the toolface has been established by slowly rotating the drill string and observing the output of various orientation devices, the mud motor and drill bit are lowered, with the drill string non-rotatable to maintain the selected toolface, and the drilling fluid pumps, "mud pumps", are energized to develop fluid flow through the drill string and mud motor, thereby imparting rotary motion to the mud motor output shaft and the drill bit that is fixed thereto. The presence of the bend angle causes the bit to drill on a curve until a desired borehole inclination has been established. To drill a borehole section along the desired inclination and azimuth, the drill string is then rotated so that its rotation is superimposed over that of the mud motor output shaft, which causes the bend section to merely orbit around the axis of the borehole so that the drill bit drills straight ahead at whatever inclination and azimuth have been established. If desired, the same directional drilling techniques can be used as the maximum depth of the wellbore is approached to curve the wellbore to horizontal and then extend it horizontally into or through the production zone. Measurement-while-drilling "MWD" systems are commonly included in the drill string above the mud motor to monitor the progress of the borehole being drilled so that corrective measures can be instituted if the various borehole parameters indicate variance from the projected plan.

Various problems can arise when sections of the wellbore are being drilled with the drill string non-rotatable and with a mud motor being operated by drilling fluid flow. The reactive torque caused by operation of a mud motor can cause the toolface to gradually change so that the borehole is not being deepened at the desired azimuth. If not corrected, the wellbore may extend to a point that is too close to another wellbore, the wellbore may miss the desired "subsurface target", or the wellbore may simply be of excessive length due to "wandering". These undesirable factors can cause the drilling costs of the wellbore to be excessive and can decrease the drainage efficiency of fluid production from a subsurface formation of interest. Moreover, a non-rotating drill string may cause increased frictional drag so that there is less control over the "weight on bit" and the rate of drill bit penetration can decrease, which can result in substantially increased drilling costs. Of course, a non-rotating drill string is more likely to get stuck in the wellbore than a rotating one, particularly where the drill string extends through a permeable zone that causes significant build up of mud cake on the borehole wall.

A patent related to the subject matter of the present invention is U.S. Pat. No. 5,113,953. The '953 patent presents a directional drilling apparatus and method in which the drill bit is coupled to the lower end of a drill string through a universal joint, and the bit shaft is pivotally rotated within the steerable drilling tool collar at a speed which is equal and opposite to the rotational speed of the drill string. The present invention is significantly advanced as compared to the subject matter of the '953 patent in that the angle of the bit shaft or mandrel relative to the drill collar of the present invention is variable rather than being fixed. Additionally, the rotary steerable drilling system of the present invention incorporates various position measurement systems and position signal responsive control. Other patents of interest related to the present invention are UK Patents GB 2 177 738 B, GB 2 172 324 B and GB 2 172 325 B. The '738 patent is entitled "Control of drilling courses in the drilling of boreholes" and discloses a control stabilizer 20 having four actuators 44. The actuators are in the form of flexible hoses or tubes which are selectively inflated to apply a lateral force to the drill collar as shown at 22 for the purpose of deflecting the drill collar and thus altering the course of the borehole being drilled. The '324 patent is of interest to the present invention in that it presents a steerable drilling tool having stabilizers 18 and 20, with a control module 22 located between them for effecting controlled deflection of the drilling tube 10 for altering the course of the wellbore being drilled. The '325 patent is of interest to the present invention in that it presents a steerable drilling tool having a stabilizer housing 31 that contains sensing means and is maintained essentially stationary during drilling by an anti-rotation device 40. Movement of the drilling tube 10 relative to a wall contact assembly 33 is accomplished by applying different pressures, in a controlled manner, to each of four actuators 44. Steering of the drill bit is accomplished by sensing direction responsive deflection of the drilling tube 10. In contrast, the present invention achieves steering of the drill bit by hydraulically maintaining an offsetting mandrel, to which the drill bit is attached, in geostationary position and oriented about a knuckle or pivot mount within a sliding tool collar while the offsetting mandrel is rotatably driven within the sliding tool collar.

The present invention is also distinguished from the teachings of the related art in the assembly of drilling system controllable mud motor and thruster apparatus and a flexible sub that can be arranged in any suitable assembly to enable directionally controlled drilling to be selectively powered by a rotary drill string, a mud motor, or both, and to provide for precision control of weight on bit and accuracy of drill bit orientation during drilling.

U.S. Pat. No. 5,265,682 presents a system for maintaining a downhole instrumentation package in a roll stabilized orientation by means of an impeller. The roll stabilized instrumentation is used for modulating fluid pressure to a set of radial pistons which are sequentially activated to urge the bit in a desired direction. The drill bit steering system of the '682 patent most notably differs from the concept of the present invention in the different means that is utilized for deviating the drill bit in the desired direction. Namely, the '682 patent describes a mechanism which uses pistons which react against the borehole wall to force the bit in a desired lateral direction within the borehole. In contrast, the rotary steerable drilling system of the present invention incorporates an automatically energized, sensor responsive hydraulic system to maintain the bit shaft of the drilling system in geostationary and angularly oriented relation with the sliding tool collar to keep the drill bit pointing in a desired borehole direction. The hydraulic bit shaft positioning system positions the bit shaft axis in its knuckle or universal joint support within the sliding tool collar in order to keep the bit shaft pointed in the desired direction. Within the scope of the present invention various position sensors and electronics of the tool are located within the sliding collar of the drilling tool, rather than in a rotating component, to ensure the accuracy and extended service life thereof.

SUMMARY OF THE INVENTION

It is a principal feature of the present invention to provide a novel drilling system that is driven by a rotary drill string or a mud motor connected to a rotary or non-rotary drill string and permits selective drilling of curved wellbore sections by precision steering of the drill bit being rotated by the drill string and steerable drilling tool;

It is also a feature of the present invention to provide a novel actively controlled rotary steerable well drilling system having a bit shaft that is rotatably driven by the drill collar during drilling operations and which is mounted intermediate its length for pivotal articulation within the tool collar for the purpose of geostationary positioning of the bit shaft and drill bit relative to the tool collar to thereby continuously point the drill bit supported thereby at desired angles of inclination and azimuth for the drilling of a curved wellbore to an intended target;

It is another feature of the present invention to provide a novel actively controlled rotary steerable well drilling system having an offsetting mandrel or bit shaft which is kept stationary at a predetermined inclination and bearing for steering a wellbore being drilled toward a predetermined subsurface target;

It is another feature of the present invention to provide a novel actively controlled rotary steerable well drilling system having within the tool a drilling fluid powered hydraulic pump that supplies pressurized fluid for position control of an offsetting mandrel by solenoid controlled energization of hydraulic positioning pistons that accomplish geostationary positioning of the articulatable offsetting mandrel for the purpose of drill bit steering;

It is another feature of the present invention to provide a novel actively controlled rotary steerable well drilling system having on-board electronic power, position sensing and control systems mounted throughout the length of a non-rotary component of the tool and thus protected against possible rotation induced damage;

It is another feature of the present invention to provide a novel actively controlled rotary steerable well drilling system having a stabilizing collar within which rotary components of the steerable drilling tool are rotatably mounted, so that the stabilizing collar is not rotatably driven and is thus free to slide or to be slowly rotated by the internal friction of the tool, which may overcome the friction of the tool collar with the wellbore wall as the tool collar is moved along the wellbore wall during drilling; and It is also a feature of the present invention to provide a novel actively controlled rotary steerable well drilling system having a substantially non-rotatable tool collar and elongate curved elastic stabilizing ribs that maintain sliding contact with the wellbore wall during drilling operations.

Briefly, the various objects and features of the present invention are realized through the provision of an actively controlled rotary steerable drilling tool having a rotary drive mandrel that is connected directly to a drill string rotary drive component, such as the output shaft of a mud motor or a rotary drill string, that is driven by the rotary table of a drilling rig. An offsetting mandrel, also sometimes referred to herein as a bit shaft, is mounted within the sliding tool collar by means of a universal mount or knuckle joint and is rotatable directly by the rotary drive mandrel for the purpose of drilling. A lower section of the offsetting mandrel projects from the lower end of the sliding tool collar and provides a connection to which the drill bit is threadedly connected. According to the concept of this invention, the offsetting mandrel axis is maintained pointed in a given direction which is inclined by a variable angle with respect to the axis of the rotary drive mandrel during rotation of the offsetting mandrel by the rotary drive mandrel, thus allowing the drill bit to drill a curved wellbore on a curve that is determined by the selected angle. A straight bore can be drilled by setting the angle between the bit shaft axis and the tool axis to zero.

The angle between the axis of the rotary drive mandrel and the axis of the offsetting mandrel is maintained by a plurality of hydraulic pistons which are located within the sliding collar of the tool and are selectively controlled and positioned by sensor responsive solenoid valves to maintain the axis of the offsetting mandrel geostationary and at predetermined angles of inclination and azimuth. Additionally, these predetermined angles of inclination and azimuth are selectively controllable responsive to surface generated control signals, computer generated signals, sensor generated signals or a combination thereof. Thus the rotary steerable drilling tool of this invention is adjustable while the tool is located downhole and during drilling for controllably changing the angle of the offsetting mandrel relative to the sliding tool collar as desired for the purpose of controllably steering the drill bit being rotated by the offsetting mandrel of the tool.

Torque is transmitted from the rotary drive mandrel to the offsetting mandrel directly through an articulatable driving connection. In addition, the hydraulic mandrel positioning pistons are servo-controlled to guarantee that the predetermined toolface is maintained in the presence of external disturbances. Since it should always remain geostationary, the offsetting mandrel is maintained in its geostationary position within the sliding tool collar by hydraulically energized pistons that are mounted for movement within the sliding tool collar. This feature is accomplished by automatic solenoid controlled hydraulic actuation of the positioning pistons which are precisely controlled responsive to signals from various position sensors and responsive to various forces that tend to alter the orientation of the axes of the sliding tool collar and the offsetting mandrel.

To enhance the flexibility of the actively controlled rotary steerable drilling tool, the tool has the capability of selectively incorporating many electronic sensing, measuring, feedback and positioning systems. A three-dimensional positioning system of the tool can employ magnetic sensors for sensing the earth's magnetic field and can employ accelerometers and gyroscopic sensors for accurately determining the position of the tool at any point in time. For control, the rotary steerable drilling tool will typically be provided with three accelerometers and three magnetometers. A single gyroscopic sensor will typically be incorporated within the tool to provide rotational speed feedback and to assist in stabilization of the mandrel, although a plurality of gyroscopic sensors may be employed as well without departing from the spirit and scope of this invention. The signal processing system of the electronics on-board the tool achieves real-time position measurement while the offsetting mandrel of the tool is rotating. The sensors and electronics processing system of the tool also provide for continuous measurement of the azimuth and the actual angle of inclination as drilling progresses so that immediate corrective measures can be taken in real time, without necessitating interruption of the drilling process. The tool incorporates a position-based control loop using magnetic sensors, accelerometers, and gyroscopic sensors to provide position signals for controlling axial orientation of the offsetting mandrel. Also from the standpoint of operational flexibility, the tool may incorporate systems for feedback, gamma ray detection, resistivity logging, density and porosity logging, sonic logging, borehole imaging, look ahead and look around sensing, and measurement of inclination at the bit, bit rotational speed, vibration, weight on bit, torque on bit, and bit side force, for example.

Additionally, the electronics and control instrumentation of the rotary steerable drilling tool provides the possibility for programming the tool from the surface so as to establish or change the tool azimuth and inclination and to establish or change the bend angle relation of the offsetting mandrel to the tool collar. The electronic memory of the on-board electronics of the tool is capable of retaining, utilizing and transmitting a complete wellbore profile and accomplishing geosteering capability downhole so it can be employed from kick-off to extended reach drilling. Additionally, a flexible sub may be employed with the tool to decouple the rotary steerable drilling tool from the rest of the bottom hole assembly and drill string and allow navigation by the electronics of the rotary steerable drilling system.

In addition to other sensing and measuring features of this invention, the actively controlled rotary steerable drilling tool may also be provided with an induction telemetry coil or coils to transmit logging and drilling information that is obtained during drilling operations to an MWD system bidirectionally through the flexible sub, and other measurement subs. For induction telemetry the rotary steerable drilling tool may also incorporate an inductor within the tool collar. The tool may also incorporate transmitters and receivers located in predetermined axially spaced relation to thus cause signals to traverse a predetermined distance through the subsurface formation adjacent the wellbore and thus measure its resistivity while drilling activity is in progress.

The electronics of the resistivity system of the tool, as well as the electronics of the various measurement and control systems, are mounted within the collar of the tool which, as mentioned above, slides along the borehole wall or may rotate slowly rather than being rotated along with rotary components of the tool. Thus, the electronics system is protected from potential rotational induced damage as drilling operations occur.

In the preferred embodiment of the present invention a hydraulic pump is provided within the sliding tool collar of the rotary steerable drilling tool to develop hydraulic pressure in the on-board hydraulic system of the tool to provide for operation of hydraulically energized components. The hydraulic pump is driven by the relative rotation of the rotary drive mandrel with respect to the tubular sliding tool collar of the tool, either by a direct rotational relationship or through a gear train to provide for optimum rotational speed range of the hydraulic pump in relation to the rotational speed of the rotary drive mandrel. The pressurized hydraulic fluid is controllably applied to piston chambers responsive to sensor signal induced actuation of solenoid valves to maintain the axis of the offsetting mandrel geostationary and at desired angles of inclination and azimuth during drilling. Hydraulic pressure generated by the hydraulic pump may also be employed in an on-board system including linear voltage differential transformers (LVDT's) to measure radial displacement of the elastic anti-rotation blades for identifying the precise position of the actively controlled rotary steerable drilling tool with respect to the centerline of the wellbore being drilled. LVDT's are also employed to sense displacement of the mandrel actuation pistons and to provide displacement signals that are processed and utilized for controlling hydraulic actuation of the pistons.

For the purpose of mechanical efficiency, according to the preferred embodiment, the offsetting mandrel positioning system employs a universal offsetting mandrel support in the form of any suitable universal joint or knuckle joint to provide the offsetting mandrel with efficient support in both the axial direction and torque and at the same time to minimize friction at the universal joint. Friction of the universal joint is also minimized by ensuring the presence of lubricating oil about the components thereof, and by excluding drilling fluid from the universal joint while permitting significant cyclical steering control movement of the offsetting mandrel relative to the tool collar and the rotary drive mandrel as drilling is in progress. The universal joint may conveniently take the form of a spine type joint, a universal joint incorporating splines and rings, or a universal joint incorporating a plurality of balls which permit relative angular positioning of the axis of the offsetting mandrel with respect to the axis of the rotary drive mandrel that is within and concentric with the tool collar.

Electrical power for control and operation of the solenoid valves and the electronics system of the drilling tool is generated by an on-board alternator which is also powered by rotation of the rotary drive mandrel relative to the sliding tool collar, with relative rotation being geared to provide for rotation of the alternator within a rotary speed range that is sufficient for output of the electrical energy that is required by the various electronic systems of the tool. The electrical output of the alternator may also be utilized for maintaining the electrical charge of a battery pack that provides electrical power for operation of the on-board electronics and for operation of various other on-board electronic equipment during times when the alternator is not being powered by flowing fluid.

BRIEF DESCRIPTION OF THE DRAWINGS

So that the manner in which the above recited features, advantages and objects of the present invention are attained can be understood in detail, a more particular description of the invention, briefly summarized above, may be had by reference to the preferred embodiment thereof which is illustrated in the appended drawings.

It is to be noted however, that the appended drawings illustrate only a typical embodiment of this invention and are therefore not to be considered limiting of its scope, for the invention may admit to other equally effective embodiments.

In the Drawings:

FIG. 1 is a schematic illustration showing a well being drilled in accordance with the present invention and showing deviation of the lower portion of the wellbore by the actively controlled rotary steerable drilling system and method thereof;

FIG. 2 is an alternative schematic illustration showing a rotary steerable drilling tool of the present invention connected in driven relation with a mud motor;

FIG. 3 is a sectional view showing the upper portion of a rotary steerable drilling system constructed in accordance with the principles of the present invention;

Figure 3:
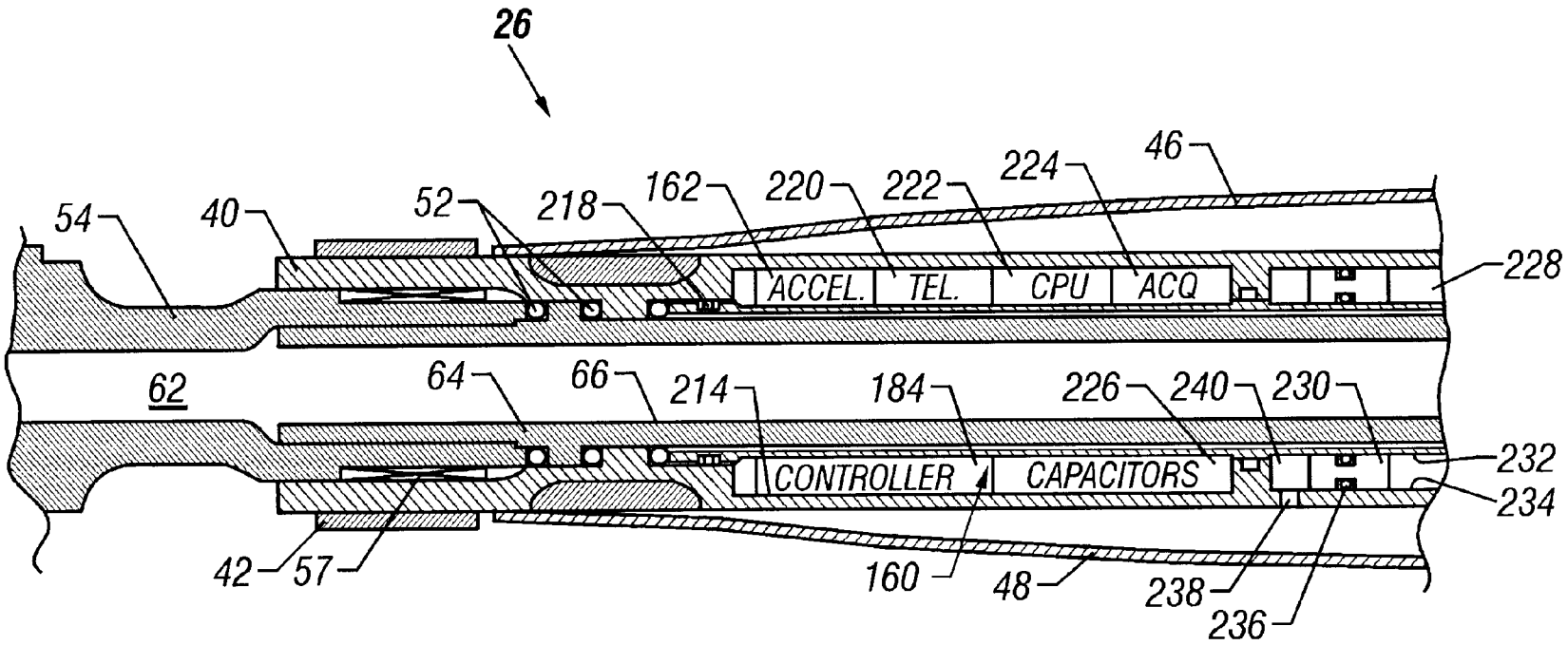
Figure 4:
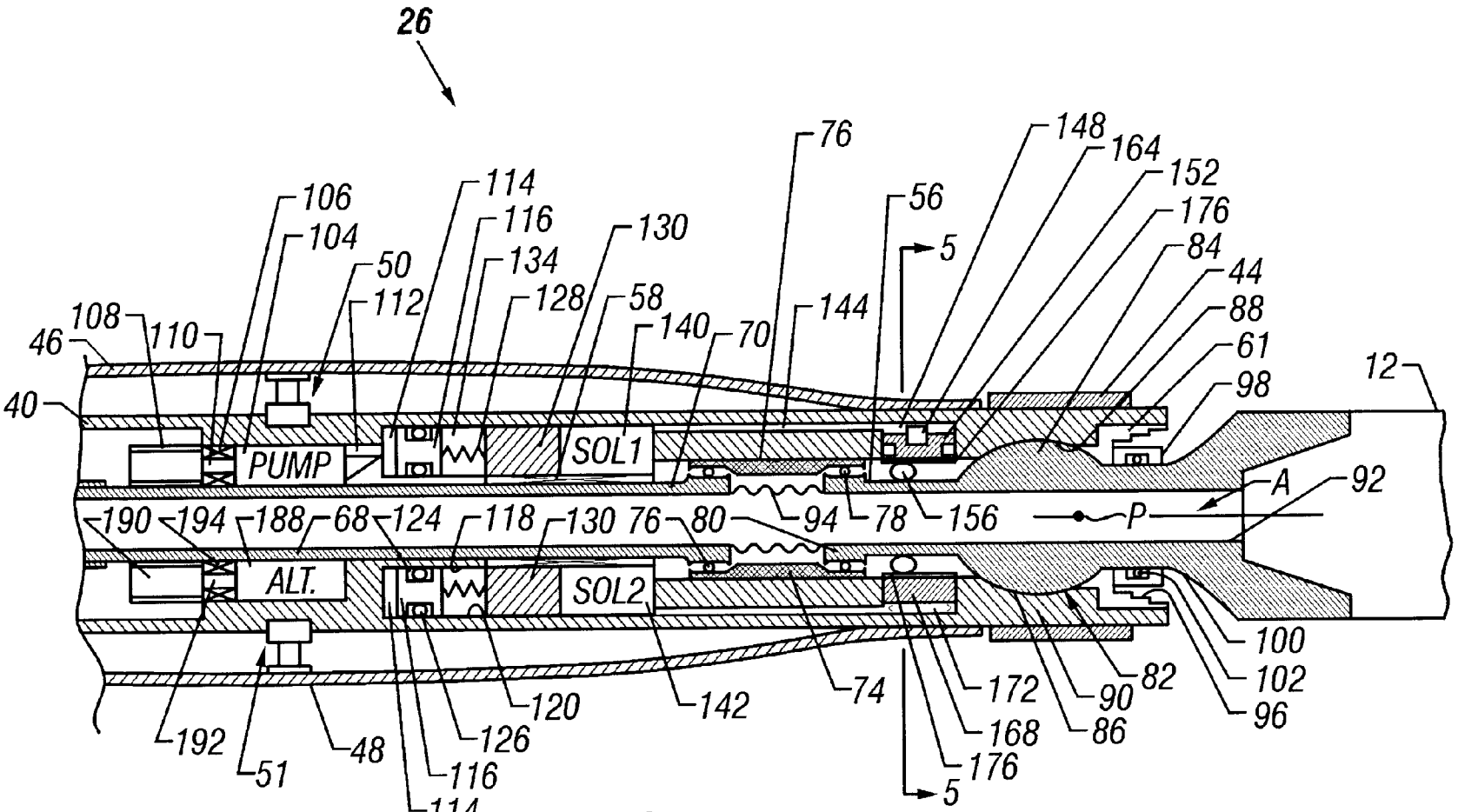
Figure 5:
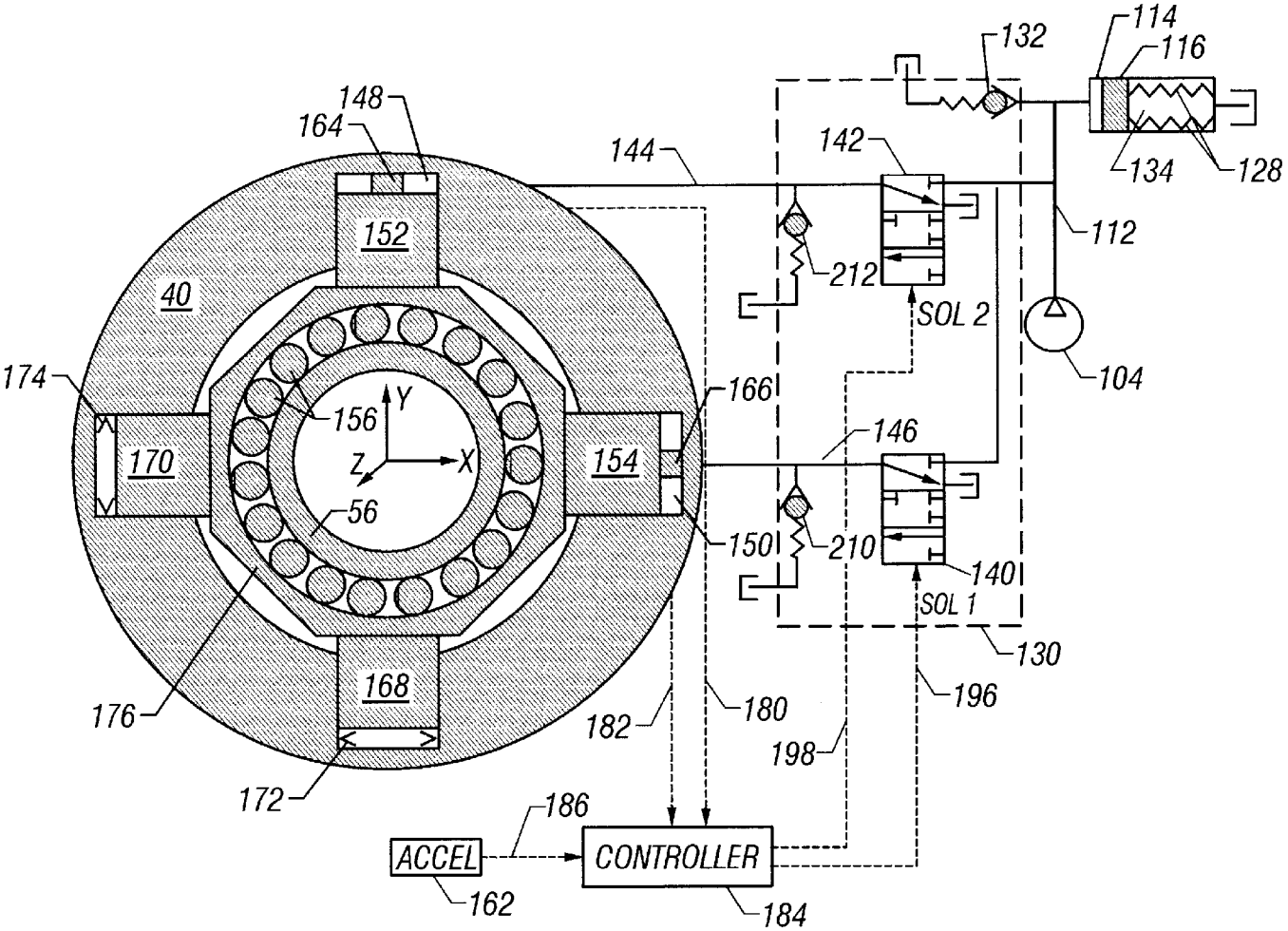

FIG. 4 is a sectional view showing the lower portion of the rotary steerable drilling system of FIG. 3 and a portion of a drill bit connected thereto for drilling; and FIG. 5 is a sectional view taken along line 5—5 of FIG. 4 and showing the hydraulically energized offsetting mandrel positioning pistons and piston return elements and further showing by hydraulic schematic illustration the control loop of the hydraulic piston actuation system of the rotary steerable drilling tool.

DESCRIPTION OF THE PREFERRED EMBODIMENT

Figure 1:
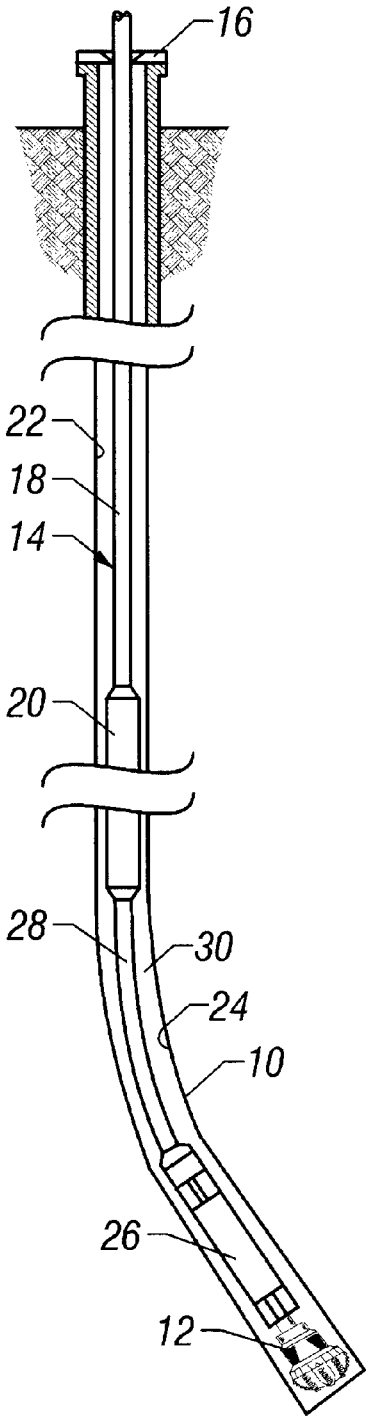

Referring now to the drawings and first to FIG. 1, a wellbore 10 is shown being drilled by a drill bit 12 that is connected at the lower end of a drill string 14 that extends upwardly to the surface where it is driven by the rotary table 16 of a typical drilling rig (not shown). The drill string 14 typically incorporates a drill pipe 18 having one or more drill collars 20 connected therein for the purpose of applying weight to the drill bit 12. The wellbore 10 is shown as having a vertical or substantially vertical upper portion 22 and a deviated, curved, or horizontal lower portion 24 which is being drilled under the control of an actively controlled rotary steerable drilling tool shown generally at 26 which is constructed in accordance with the present invention. To provide the flexibility that is needed in the curved lower portion 24 of the wellbore, a lower section of drill pipe 28 may be used to connect the drill collars 20 to the drilling tool 26 so that the drill collars will remain in the vertical upper portion 22 of the wellbore 10. The lower portion 24 of wellbore 10 will have been deviated from the vertical upper portion 22 by the steering activity of the drilling tool 26 in accordance with the principles set forth herein. The drill pipe 28, shown immediately adjacent to the rotary steerable drilling tool, may incorporate a flexible sub which can provide the rotary steerable drilling system with enhanced accuracy of drilling. In accordance with the usual practice, drilling fluid or "mud" is circulated by surface pumps (not shown) down through the drill string 14 where it exits through jets that are defined in the drill bit 12 and returns to the surface through the annulus 30 between the drill string 14 and the wall of the wellbore 10. As will be described in detail below, the rotary steerable drilling tool 26 is constructed and arranged to cause a drill bit 12, connected thereto, to drill along a curved path that is designated by the control settings of the drilling tool. The angle of the offsetting mandrel supporting the drill bit 12 in controlled angular relation with respect to the tubular collar of the drilling tool is maintained even though the drill bit and the internal rotary drive mandrel of the drilling tool are being rotated by the drill string, mud motor, or other rotary mechanism, thereby causing the drill bit to be steered for drilling a curved wellbore section. Steering of the drilling tool is selectively accomplished from the standpoint of inclination and from the standpoint of azimuth. Additionally, the offsetting mandrel settings of the rotary steerable drilling tool may be changed as desired, such as by mud pulse telemetry, to cause the drill bit to selectively alter the course of the wellbore being drilled to thereby direct the deviated wellbore with respect to X, Y and Z axes for precision steering of the drill bit and thus precision control of the wellbore being drilled.

Figure 2:
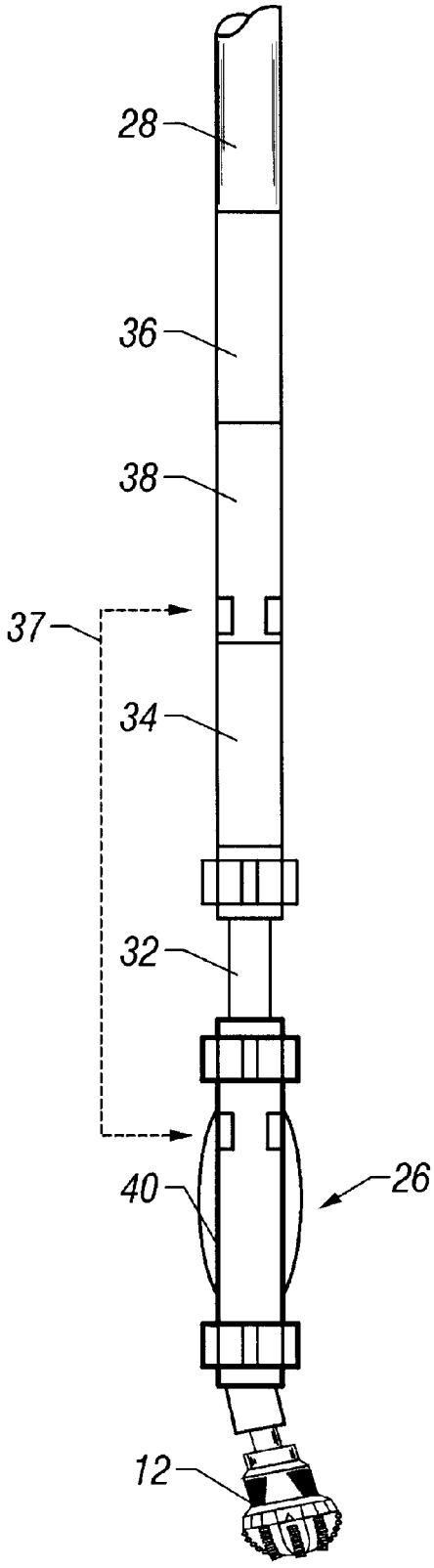

FIG. 2 is a schematic illustration showing the rotary steerable drilling tool 26 of the present invention being driven by the output shaft 32, in this case a flexible shaft, of a mud motor 34 which is connected to a rotatable or non-rotatable drill string 18, or to a flexible drill string section 28, and is adapted for steering control by electronically processed acoustic control pulses that are transmitted from the surface through the drilling mud column according to known technology. For control pulse processing an acoustic pulse processing and control unit 36 is connected within the drill string and is electronically connected with the various controllable systems of the rotary steerable drilling system, including the rotary steerable drilling tool 26. The processing and control unit 36 incorporates acoustic pulse sensing means for sensing mud pulse telemetry from acoustic pulse transmitting equipment located at the surface and for generating electronic control signals responsive thereto. These electronic control signals are then processed by on-board electronics to provide control signals that may be utilized for controlling a wide range of equipment and systems on-board the rotary steerable drilling tool 26. For example, some of the control signals may be employed for controlling steering of the drill bit 12 to correct or change the direction of borehole drilling while drilling is taking place. Other control signals may be employed for activating and de-activating various on-board systems, such as formation resistivity measuring systems, two way induction telemetry systems, and mud motor control systems. A signal transmission system 38, commonly referred to as a "short-hop telemetry system", may be connected into the drill string to provide induction transmission, indicated schematically at 37, through the formation immediately surrounding the borehole and to provide for signal communication to and from the control systems of the rotary steerable drilling tool and, if desired, to provide the electronics of the rotary steerable drilling tool with formation data. This system provides for integration of a mud motor between the signal transmission system 38 and the actively controlled rotary steerable drilling tool 26.

Referring now to the sectional views of FIGS. 3 and 4, which show respective upper and lower sections of the actively controlled rotary steerable drilling tool 26, representing the preferred embodiment of the present invention, the drilling tool 26 is provided with a tubular sliding tool collar 40 which is intended to be moved in essentially sliding relation along the wall of the borehole being drilled, either sliding in linear fashion or perhaps being slowly rotated by the internal friction of the drilling tool as drilling is in progress. For example, the sliding tool collar 40 may be rotated by its internal friction at a few revolutions per hour while the drill bit is being rotated at a much higher rate of rotation, such as 50 revolutions per minute, for example. Rotation of the sliding tool collar 40 at a very slow rate will not interfere with the various mechanical and electronic systems of the rotary steerable drilling tool 26. Rotation of the sliding tool collar is minimized for the purpose of protecting the various system electronics and sensor systems contained therein from damage that may be caused by forces induced by rotation and to maintain an efficient and stabilized relationship of the tool collar with respect to the wellbore being drilled.

The tubular sliding tool collar 40 is provided with stabilizer elements 42 and 44 at the respective upper and lower ends thereof to provide for stabilization and centralization of the tool collar within the wellbore during drilling. An antenna for two way induction telemetry is also integrated within the sliding tool collar. Additionally, for preventing rotation of the rotary steerable drilling tool 26 during drilling, the tool collar 40 is also provided with a plurality of, preferably three or more, elongate curved elastic anti-rotation members, two of which are shown at 46 and 48, which have respective upper and lower ends thereof disposed in substantially fixed relation with the tool collar 40 while the intermediate portions thereof project outwardly from the tool collar to a sufficient extent that they are yielded inwardly toward the tool collar by contact with the borehole wall. The curved elastic anti-rotation members 46 and 48 thus have sliding contact with the borehole wall at all times and thus assist in restraining rotation of the tool collar 40 during drilling to minimize, and in most cases eliminate, rotation of the tool collar during drilling. The anti-rotation members 46, 48 also assist the stabilizers in centralization of the tool collar 40 within the wellbore. By preventing rotation of the tool collar 40 of the rotary steerable drilling tool 26 the elastic anti-rotation members allow the use of accelerometers to measure toolface orientation, thus eliminating or minimizing the need for large bandwidth sensors, i.e., gyroscopes, in the drilling tool and thereby significantly simplifying the on-board electronics systems of the tool. Additionally, relative deflection of the elastic anti-rotation members 46, 48 and thus the position of the tool collar 40 within the borehole may also be measured. The elastic anti-rotation members 46, 48 and the tool collar 40 may be provided with hydraulic piston and cylinder type linear voltage differential transformer (LVDT) assemblies, as shown generally at 50 and 51 in FIG. 4, which measure displacement hydraulic fluid as the anti-rotation members move radially inwardly and outwardly as the tool collar becomes temporarily offset from the centerline of the borehole, and which generate position signals that are electronically processed and utilized for steering during drilling. These position signals are used to provide a caliper measurement by measuring the axial displacement of each of the elastic anti-rotation members.

A rotary drive shaft 54, which may be the output shaft of a mud motor, such as shown at 32 in FIG. 2, a drive connection sub driven by the output shaft of a mud motor, a drive connection of a rotary drill string, or any other suitable rotary drive means, extends into the tool collar 40 and is rotatable for the purpose of imparting driving force to an offsetting mandrel 56 which will be described in greater detail below. During its rotation, the rotary drive shaft 54 rotates within the tool collar 40 while the tool collar is restrained from rotation at the same rotary speed as the rotary drive shaft 54 by the coupled, frictionally sliding relationship of the elastic anti-rotation members 46 and 48 with the borehole wall. The rotary drive shaft 54 is sealed with respect to the tool collar 40 by seal or packing assembly 57. The seal or packing assembly 57 cooperates with rotary drive shaft 54 and tool collar 40 to define the uphole end of internal oil chamber 60 which is isolated at its downhole end by seal or packing assembly 58 from the drilling fluid flowing into the tool through rotary drive shaft 54. Oil chamber 60 contains a quantity of oil or other lubricating and protective fluid medium. Seal or packing assembly 58 also functions to isolate pressurized hydraulic fluid from internal oil chamber 60. The rotary drive shaft 54 defines an internal flow passage 62 through which drilling fluid flows en route to the drill bit 12. The rotary drive shaft 54 mates with an elongate rotary drive mandrel 64 which is fixed to the rotary drive shaft 54, such as by threaded connection, and also defines an internal bore 66 forming a part of the drilling fluid flow passage through the drilling tool. The elongate rotary drive mandrel 64 cooperates with the tool collar 40 to define a bearing chamber having thrust shoulders and receiving the bearings 52 so that axially and radially oriented thrust forces between the rotary drive mandrel 64 and the tool collar 40 will be accommodated during drilling operations. The rotary drive mandrel 64 is provided with a lower tubular drive section 68 about which the seal or packing assembly 58 is received and which defines a terminal drive connection 70 having an articulated driving connection with a drive sleeve 74. A plurality of spherical drive elements 76 are interposed between the terminal drive connection 70 and the upper end of the drive sleeve 74 and are seated within drive receptacles that are cooperatively defined by the terminal drive connection 70 and the upper end of the drive sleeve 74. The rotary drive mandrel 64 and its lower tubular drive section 68 are maintained in co-axial relation with the tool collar 40 by the bearings 52, while the drive sleeve 74 is permitted to articulate and yet maintain its driving connection with offsetting mandrel 56. The lower end of drive sleeve 74 is essentially a duplicate of the upper end thereof. Spherical drive elements 78 captured within drive receptacles cooperatively defined by the lower end of the drive sleeve 74 and the upper driven connection 80 of offsetting mandrel 56 provide a direct driving connection between drive sleeve 74 and offsetting mandrel 56, while at the same time permitting relative articulation between the drive sleeve and the offsetting mandrel. Alternatively, a one-piece mandrel with a flexible portion therein may be employed in place of the rotary drive mandrel 64, the articulated driving connection, and the offsetting mandrel 56.

The offsetting mandrel 56 is mounted for rotation within tool collar 40 for omnidirectional movement about a pivot-like knuckle joint 82 which may be of the ball pivot configuration and function shown in FIG. 4 and described below. In the alternative, knuckle joint 82 may be of splined configuration or of any other suitable configuration that will permit omnidirectional movement of offsetting mandrel 56 and, during rotary driving thereof, will permit the offsetting mandrel 56 to be oriented within tool collar 40 to maintain its axis in geostationary relation with the formation being drilled.

As shown in FIG. 4, knuckle joint 82 of offsetting mandrel 56 with respect to tool collar 40 is defined by a spherical element 84 which is integral with or fixed to offsetting mandrel 56. Spherical element 84 defines an external spherical surface 86 which is received within a mandrel support receptacle 88 which is defined within the lower end 90 of the tool collar 40. The mandrel support receptacle 88 defines an internal spherical support surface segment having mating relation with the external spherical surface 86 of the spherical knuckle element 84. The offsetting mandrel 56 is therefore permitted to pivot relative to the lower end 90 of the tool collar 40 about an imaginary pivot point P, while simultaneously being rotated for driving of the drill bit 12 by the rotary driving connection that is established between the lower tubular drive section 68 of rotary drive mandrel 64 and drive sleeve 74. The pivotal movement of offsetting mandrel 56 about pivot point P, while its rotational driving connection is maintained, is permitted by the articulating driving connection that is established at each end of the drive sleeve 74 by the respective spherical drive elements 76 and 78.

During drilling operations pivotal movement of offsetting mandrel 56 relative to tool collar 40 must be accommodated while preventing intrusion of drilling fluid from the internal bore 66 of rotary drive mandrel 64 and bore 92 that extends through offsetting mandrel 56 and is in communication with the internal flow passages of the drill bit 12. In accordance with the embodiment shown in FIGS. 3 and 4, a yieldable bellows seal element 94 establishes sealed connection with the lower tubular drive section 68 of rotary drive mandrel 64 and the upper end of offsetting mandrel 56. Thus, as offsetting mandrel 56 is moved about its pivot point P, the bellows seal element 94 maintains an effective seal to prevent drilling fluid intrusion into the oil or hydraulic fluid chambers of the tool collar 40. At the lower end of the rotary steerable drilling tool another bellows seal element 96 is connected in sealed relation with the lower end of tool collar 40 and is also connected to a circular seal retainer element 98 that is located about a cylindrical section 100 of offsetting mandrel 56 and is provided with a circular sealing element 102 which is located within an internal seal groove of the circular seal retainer element 98. As offsetting mandrel 56 is rotated during drilling activity, circular seal retainer element 98 remains in non-rotatable relation with respect to tool collar 40 and sealing element 102 maintains sealing engagement with the cylindrical section 100 of offsetting mandrel 56. The flexible bellows seal element 96 maintains a seal between tool collar 40 and seal retainer element 98 and prevents drilling fluid intrusion into the internal oil chamber 61.

During drilling, the axis of offsetting mandrel 56 is maintained geostationary as offsetting mandrel 56 is rotated by the rotary drive mandrel 64. According to the present invention geostationary axial positioning of offsetting mandrel 56 is established hydraulically under the control of solenoid valves that are selectively actuated in response to appropriate position sensing signals . Referring to FIG. 4, hydraulic pressure induced energy for controlling the position of offsetting mandrel 56 is generated by a hydraulic pump 104 which is located within a pump receptacle defined within tool collar 40. The pump drive shaft 110 is supported by appropriate bearings 106. Hydraulic pump 104 is driven by a rotary drive mechanism 108 responsive to rotation of the rotary drive mandrel 64 relative to tool collar 40. The rotary drive mechanism 108 may be coupled for driven rotation by the lower tubular drive section 68 of rotary drive mandrel 64 and may incorporate an internal gear train or transmission to establish a desired rotational relationship of the tubular drive section 68 with pump drive shaft 110 for imparting appropriate rotation and torque to the drive mechanism of hydraulic pump 104 to thus provide the pump with appropriate hydraulic pressure output and volume for accomplishing appropriate movement of offsetting mandrel 56 as the mandrel is rotated.

The hydraulic fluid output of hydraulic pump 104 is conducted to a fluid passage 112 that is in communication with an annular hydraulic fluid chamber 114 having an annular piston 116 therein which is sealed to internal and external cylindrical walls 118 and 120 of hydraulic fluid chamber 114 by means of internal and external circular sealing elements 124 and 126 which are carried within respective seal grooves of the piston 116. The piston 116 is urged toward hydraulic pump 104 by one or more compression springs 128 which react against a fixed annular manifold block 130 having a plurality of valves therein.

The arrangement of annular manifold block 130 is illustrated schematically in FIG. 5. A return check valve 132, a spring-urged ball check valve, controls the return of pressurized hydraulic fluid to an annular hydraulic fluid accumulator chamber 134 which feeds hydraulic pump 104. A pair of solenoid actuated valves 140 and 142 control admission of pressurized hydraulic fluid to hydraulic fluid supply passages 144 and 146, respectively. The supply passages 144 and 146 supply pressurized hydraulic fluid to hydraulic cylinders 148 and 150, respectively, for actuation of hydraulic pistons 152 and 154. The hydraulic pistons 152 and 154 act through bearings or other contact members 156 to impart positioning force to offsetting mandrel 56. The pistons 152 and 154 are independently movable responsive to position signal controlled actuation of the solenoid valves 140 and 142 for pivoting of offsetting mandrel 56 about its pivot point P so that offsetting mandrel 56 is oriented by the effect of the pistons. The relative positions of the offsetting mandrel actuating pistons 152 and 154 are also determined by sensing means and controlled by the solenoid actuated valves 140 and 142 for the purpose of maintaining the longitudinal axis A of offsetting mandrel 56 in geostationary relation with respect to the formation being drilled and oriented at specific angles of inclination and azimuth to accomplish drilling of a curved wellbore along a predetermined path for drilling to a subsurface target.

As shown particularly in FIG. 3, the rotary steerable drilling tool of the present invention is provided with an electronics and sensor package shown generally at 160. The electronics and sensor package incorporates a control loop which includes a three-axis accelerometer 162 to measure the orientation of the tool collar 40 relative to the gravity field.

As shown particularly in FIG. 5, the cylinder and piston assemblies are provided with a pair of LVDT's 164 and 166 which function to measure the displacement of the pistons 152 and 154 as they are moved either by hydraulic pressure responsive to actuation of the solenoid actuated valves 140 and 142 or by spring energized return such as by return members 168 and 170 having compression springs 172 and 174 which provide a spring energized reaction force through the return members 168 and 170 via a mandrel positioning element 176 that is in force transmitting engagement with the offsetting mandrel 56 through the plurality of bearings or contact members 156 that accommodate rotation and pivotal articulation of offsetting mandrel 56 while at the same time permitting positioning actuation of offsetting mandrel 56. The LVDT's 164 and 166 measure the positions of each of the hydraulic pistons 152 and 154 relative to the tool collar 40 and transmit these measurement signals via signal conductors 180 and 182 to a controller 184. Signals from the three-axis accelerometer 162 are also conducted via a signal conductor 186 to the controller 184.

Electrical power for operation of the controller 184 and other electronic components of the rotary steerable drilling tool of this invention is provided by an alternator 188, shown in FIG. 4, having an alternator drive coupling or transmission 190 that is driven by the rotary drive mandrel 64 via the lower tubular drive section 68 thereof. The alternator drive coupling 190 has an output shaft 192 that is supported within the tool collar 40 by a bearing 194 and is disposed in driving connection with the alternator 188. The drive coupling or transmission 190 may be of any suitable character, such as a gear train or belt drive, for example.

As shown schematically in FIG. 5, the controller 184 provides control signal outputs for solenoid operation via a signal conductor 196 for controlling actuation of solenoid actuated valve 140 and a control signal output via signal conductor 198 for controlling actuation of solenoid actuated valve 142. Thus, the solenoid actuated valves 140 and 142 are actuated responsive to control signals from the controller 184 responsive to signal input from the LVDT's 164 and 166 and the accelerometer 162. The signals from LVDT's 164 and 166 identify controlled deviation of the axis of offsetting mandrel 56 along X and Y axes; thus, the hydraulic pistons 152 and 154 control the orientation of the axis A of offsetting mandrel 56 within tool collar 40 responsive to control of the solenoid actuated valves 140 and 142 for hydraulically energizing the pistons. Pressure control to the hydraulic cylinders 148 and 150 is established by pressure relief valves 210 and 212.

Referring now, again, to FIG. 3, tool collar 40 is shown to define an internal annular cavity 214 within which various electronics, control and sensor systems are located. This cavity is isolated from the protective oil medium by an isolation sleeve 216 having its ends sealed with respect to tool collar 40 by means of circular sealing elements 218 that are received within respective seal grooves defined within end portions of the isolation sleeve 216. Various electronic components such as a telemetry package 220, central processing unit 222, and a data acquisition package 224 are located within the internal annular cavity 214. In addition to controller 184, a capacitor bank 226 may also be located within the cavity 214 to provide sufficient stored electrical energy for actuation of the solenoids of the solenoid valves and for accomplishing other control features that are appropriate for steering control of the rotary steerable drilling tool.

The internal oil chamber 228 which is isolated from the environmental medium externally of tool collar 40 by a free piston 230 having sealed relation with internal and external cylindrical surfaces 232 and 234 by a circular sealing element 236. The internal oil chamber 228 is balanced with the pressure of the environmental medium by communicating environmental pressure through a vent port 238 to the environmental side 240 of the chamber. Thus, the pressure of the protective oil medium within the internal oil chamber 228 is pressure balanced with respect to environmental pressure regardless of the location of the drilling tool within the well.

In view of the foregoing it is evident that the present invention is one well adapted to attain all of the objects and features set forth above, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for drilling wells and simultaneously steering a drill bit with an actively controlled rotary steerable drilling system, comprising:

(a) rotating within the wellbore being drilled a drive component within a sliding tool collar, said drive component having rotary driving relation with an offsetting mandrel pivotally mounted within said sliding tool collar and supporting a drill bit;

(b) providing steering control signals;

(c) responsive to said steering control signals, hydraulically positioning said offsetting mandrel about its pivot mount during driving rotation of said offsetting mandrel by said rotary drive component for maintaining the axis of said offsetting mandrel substantially geostationary and at predetermined angles of inclination and bearing; and (d) slidably moving said sliding tool collar in coupled relation with the wellbore wall during drilling.

2. The method of claim 1, wherein said sliding tool collar has external elastic members projecting substantially radially outwardly therefrom, said method further comprising:

(e) maintaining sliding contact of said external elastic members with the wellbore wall during drilling for substantially preventing rotation of said tool collar within the wellbore during drilling.

3. The method of claim 1, wherein said sliding tool collar houses on-board systems for generating hydraulic fluid pressure and electrical energy and hydraulic piston means for imparting positioning control to said offsetting mandrel relative to said sliding tool collar during rotation of said offsetting mandrel by said rotary drive component and having electrically controlled valve means for controlling hydraulic pressure induced movement of said hydraulic piston means, said method further comprising:

(e) generating hydraulic pressure and electrical energy responsive to drilling fluid flow; and (f) electrically actuating said electrically controlled valve means responsive to said steering signals for controlling transmission of hydraulic pressure to said hydraulic piston means for causing hydraulic positioning of said offsetting mandrel.

4. The method of claim 3, wherein said piston means comprises at least two pistons each being interposed between and in force transmitting relation with said sliding tool collar and said offsetting mandrel, said method further comprising:

(g) selectively and independently controllably increasing and reducing hydraulic pressure to each of said pistons for causing said piston actuated pivotal positioning of said offsetting mandrel within said sliding tool collar.

5. The method of claim 4, wherein said hydraulic piston means are movably located within hydraulic cylinder means, said method further comprising:

(h) detecting the respective positions of said piston means within said cylinder means and relating the respective positions of said piston means to pivotal positions of said offsetting mandrel within said sliding tool collar;

(i) identifying respective position change of said piston means for desired pivotal position change of said offsetting mandrel; and (j) controllably actuating said electrically controlled valve means for independently controlling hydraulic pressure communication to said cylinder means for accomplishing said desired position change of said piston means.

6. The method of claim 5, further comprising:

(k) detecting the volume of hydraulic fluid within said hydraulic cylinder means for identification of piston position within said hydraulic cylinder means;

(l) changing the volume of hydraulic fluid within said hydraulic cylinder means to thus change said piston position and thus change the position of said offsetting mandrel within said sliding tool collar; and (m) sequentially changing the position of said offsetting mandrel within said sliding tool collar to thus maintain said offsetting mandrel in substantially geostationary relation and oriented with respect to azimuth and inclination during rotation thereof by said rotary drive component.

7. The method of claim 1, wherein said providing steering control signals comprises:

(a) sensing the location and orientation of said tool collar and the angular position of said offsetting mandrel relative to said sliding tool collar and generating real time position signals;

(b) processing said real time position signals and generating steering control signals; and (c) controlling said positioning of said offsetting mandrel with said steering control signals.

8. The method of claim 1, wherein said rotary steerable drilling system comprises on-board electronics for receiving steering control signals, said method further comprising:

(e) transmitting steering control signals from a surface location to said on-board electronics; and (f) controlling said positioning of said offsetting mandrel with said steering control signals.

9. The method of claim 1, wherein said sliding tool collar has at least two hydraulic cylinders therein each having a hydraulic piston disposed in positioning engagement with said offsetting mandrel, a pressurized hydraulic fluid supply to said hydraulic cylinders and electrically controlled hydraulic fluid control valve means for selectively communicating pressurized hydraulic fluid to said hydraulic cylinders and further having an electronic controller for receiving position signals and selectively actuating said electrically controlled hydraulic fluid control valve means for hydraulically controlled positioning of said offsetting mandrel relative to said sliding tool collar, said method further comprising:

(e) generating electronic piston position signals representing the positions of said hydraulic pistons within said hydraulic cylinders;

(f) providing electronic tool collar position signals representing the position of said sliding tool collar; and (g) processing said electronic piston position signals and said electronic tool collar position signals by said controller and providing valve position output signals from said controller for changing the position of said hydraulic fluid control valve means when necessary to alter the position of said offsetting mandrel relative to said sliding tool collar.

10. A rotary steerable well drilling system, comprising:

(a) a sliding tool collar;

(b) means for maintaining coupling of said sliding tool collar with the wall of the wellbore being drilled and substantially preventing rotation of said sliding tool collar during drilling;

(c) an offsetting mandrel mounted within said sliding tool collar for pivotal movement relative to said sliding tool collar and for rotation relative to said sliding tool collar;

(d) means for imparting driving rotation to said offsetting mandrel; and (e) hydraulic actuator means for maintaining said offsetting mandrel selectively pivotally positioned within said sliding tool collar during its rotation within said sliding tool collar to thus maintain said offsetting mandrel and a drill bit attached thereto pointed in a selected direction for steering the drill bit along an intended course.

11. The rotary steerable drilling system of claim 10, wherein said hydraulic actuator means comprises:

(a) hydraulic cylinder means within said sliding tool collar;

(b) hydraulic piston means within said hydraulic cylinder means and having force transmitting relation with said offsetting mandrel;

(c) means for supplying pressurized hydraulic fluid to said hydraulic cylinder means for position maintaining pivotal movement of said offsetting mandrel within said sliding tool collar; and (d) means responsive to positioning signals for controllably actuating said means for supplying pressurized hydraulic fluid and thus maintaining said offsetting mandrel selected positioned relative to said sliding tool collar.

12. The rotary steerable well drilling system of claim 10, wherein said means for maintaining coupling of said sliding tool collar with the wall of the wellbore being drilled comprises:

resilient coupling means supported by said sliding tool collar and projecting radially therefrom sufficiently for forcible engagement with the wall of the wellbore.

13. The rotary steerable well drilling system of claim 12, wherein said resilient coupling means comprises a plurality of resilient coupling elements located in spaced relation about said sliding tool collar; and further comprising:

means for detecting the relative positions of said resilient coupling elements in relation to said sliding tool collar and generating electronic signals representing said relative positions and thus a measurement of the diameter of the wellbore being drilled.

14. The rotary steerable well drilling system of claim 10, wherein said means for maintaining coupling of said sliding tool collar with the wall of the wellbore being drilled comprises:

a plurality of elongate elastic blades having at least one end thereof connected with said sliding tool collar, said plurality of elongate elastic blades projecting radially outwardly from said sliding tool collar for forcible coupling engagement with the wall of the wellbore.

15. The rotary steerable well drilling system of claim 10, wherein said means for maintaining coupling of said sliding tool collar with the wall of the wellbore being drilled comprises:

a plurality of elongate curved elastic blades each having ends and a central portion, said ends connected with said sliding tool collar, and said central portions of each of said plurality of elongate elastic blades projecting radially outwardly from said sliding tool collar for forcible coupling engagement with the wall of the wellbore.

16. The rotary steerable well drilling system of claim 10, further comprising:

(f) a universal joint within said sliding tool collar; and wherein said offsetting mandrel is pivotally and rotatably supported by said universal joint permitting both rotational and omnidirectional pivotal movement of said offsetting mandrel relative to said sliding tool collar.

17. The rotary steerable well drilling system of claim 10, wherein said means for imparting driving rotation to said offsetting mandrel comprises:

(a) a tubular rotary drive shaft defining a flow passage and located within said sliding tool collar and having a driven end adapted for connection with a rotary drive element and having a drive end;

(b) bearing means supporting said tubular rotary drive shaft within said sliding tool collar; and (c) means establishing an articulated drive connection of said drive end of said tubular rotary drive shaft with said offsetting mandrel.

18. The rotary steerable well drilling system of claim 17, wherein said offsetting mandrel defines a flow passage for flow of drilling fluid therethrough; and further comprising:

(f) collar seal means establishing a sealed partition between said sliding tool collar and said offsetting mandrel and defining a protective fluid chamber for containing a protective fluid medium, said collar seal means isolating said chamber from intrusion by drilling fluid; and (g) mandrel seal means establishing seals with said offsetting mandrel and with said drive end of said tubular rotary drive shaft and also isolating said protective fluid chamber from intrusion by drilling fluid.

19. The rotary steerable well drilling system of claim 10, further comprising:

(f) a hydraulic fluid supply system located within said sliding tool collar and powered by rotation of said drive means during drilling, said hydraulic fluid supply system supplying pressurized hydraulic fluid to said hydraulic actuator means;

(g) an electrical power supply system located within said sliding tool collar and powered by rotation of said drive means during drilling; and (h) electrically operated valve means incorporated within said hydraulic fluid supply system and controlling supply of pressurized hydraulic fluid to said hydraulic actuator means.

20. The rotary steerable well drilling system of claim 19, further comprising:

(i) position sensing means located within said sliding tool collar for sensing the position of said sliding tool collar within the formation being drilled and providing position signals; and (j) controller means located within said sliding tool collar and receiving said position signals, said controller means providing valve control output signals for selectively controlling operation of said electrically operated valve means.

21. The rotary steerable well drilling system of claim 10, further comprising:

(f) hydraulic fluid supply means located within said sliding tool collar;

(g) electric power supply means located within said sliding tool collar;

(h) electrically operated valve means incorporated within said hydraulic fluid supply means and controlling supply of pressurized hydraulic fluid to said hydraulic actuator means;

(i) position sensing means sensing the position of said hydraulic actuator means and providing a position signal output; and (j) controller means receiving and processing said position signal output and providing control signals for selectively controlling actuation of said electrically operated valve means.

22. The rotary steerable well drilling system of claim 21, further comprising:

(k) telemetry means located within said sliding tool collar for receiving positioning control signals transmitted from the surface and providing a telemetry signal output; and wherein said controller means receives and processes said telemetry signal output.

23. The rotary steerable well drilling system of claim 21, further comprising:

(k) at least one accelerometer located within said sliding tool collar for detecting position changes of said sliding tool collar and providing position signals responsive thereto; and wherein said controller means receives and processes said position signals.

24. The rotary steerable well drilling system of claim 10, wherein:

said hydraulic actuator means comprises at least two hydraulically movable elements each having force transmitting relation with said offsetting mandrel at locations remote from said pivotal mount within said sliding tool collar; and wherein upon actuation thereof said hydraulically movable elements move said offsetting mandrel about said pivotal mount to maintain selective positioning thereof relative to said sliding tool collar.

25. A method for drilling wells and simultaneously steering a drill bit with an actively controlled rotary steerable drilling system, comprising:

(a) rotating within the wellbore being drilled a drive component within a sliding tool collar, said drive component having rotary driving relation with an offsetting mandrel pivotally mounted within said sliding tool collar and supporting a drill bit;

(b) providing steering control signals;

(c) responsive to said steering control signals, positioning said offsetting mandrel about its pivot mount during driving rotation of said offsetting mandrel by said rotary drive component for maintaining the axis of said offsetting mandrel substantially geostationary and at predetermined angles of inclination and bearing; and (d) slidably moving said sliding tool collar in coupled relation with the wellbore wall during drilling.

26. A rotary steerable well drilling system, comprising:

(a) a sliding tool collar;

(b) means for maintaining coupling of said sliding tool collar with the wall of the wellbore being drilled and substantially preventing rotation of said sliding tool collar during drilling;

(c) an offsetting mandrel mounted within said sliding tool collar for pivotal movement relative to said sliding tool collar and for rotation relative to said sliding tool collar;

(d) means for imparting driving rotation to said offsetting mandrel; and (e) means for maintaining said offsetting mandrel selectively pivotally positioned within said sliding tool collar during its rotation within said sliding tool collar to thus maintain said offsetting mandrel and a drill bit attached thereto pointed in a selected direction for steering the drill bit along an intended course.

* * * * *